United States Patent [19]

Cheney

[11] Patent Number: 4,508,788

[45] Date of Patent: Apr. 2, 1985

[54] PLASMA SPRAY POWDER

[75] Inventor: Richard F. Cheney, Sayre, Pa.

[73] Assignee: GTE Products Corporation, Stamford, Conn.

[21] Appl. No.: 587,833

[22] Filed: Mar. 9, 1984

Related U.S. Application Data

[63] Continuation of Ser. No. 420,456, Sep. 9, 1982, abandoned.

[51] Int. Cl.[3] ..... B32B 15/00; C23C 7/00

[52] U.S. Cl. ..... 428/570; 427/34; 427/423; 428/552; 428/564; 428/937; 75/252

[58] Field of Search ..... 75/251-255; 428/552, 564, 570, 937; 427/34, 423

[56] References Cited

U.S. PATENT DOCUMENTS

| | | | |
|---|---|---|---|
| 3,617,358 | 11/1971 | Dittrich | 75/252 |
| 3,703,224 | 11/1972 | Bray | 428/564 |
| 3,881,911 | 5/1975 | Cheney et al. | 75/0.5 BB |
| 3,938,814 | 2/1976 | Cromwell | 428/937 |
| 3,974,245 | 8/1976 | Cheney et al. | 75/0.5 BA |
| 3,990,862 | 11/1976 | Dahl et al. | 428/613 |
| 4,080,431 | 3/1978 | Moss | 75/0.5 BB |
| 4,175,611 | 11/1979 | Fletcher | 428/552 |
| 4,293,619 | 10/1981 | Landingham et al. | 428/552 |
| 4,392,927 | 7/1983 | Fabian et al. | 427/423 |

FOREIGN PATENT DOCUMENTS

| | | | |
|---|---|---|---|
| 670785 | 9/1963 | Canada | 75/0.5 BB |
| 1926136 | 2/1970 | Fed. Rep. of Germany | 427/423 |
| 2456435 | 8/1976 | Fed. Rep. of Germany | 428/552 |

*Primary Examiner*—W. Stallard

*Attorney, Agent, or Firm*—Robert E. Walter

[57] ABSTRACT

A plasma spray powder comprising a uniform powder blend of silicon nitride and a plasma meltable metal produces a coating having some of the properties of silicon nitride.

5 Claims, No Drawings

PLASMA SPRAY POWDER

This application is a continuation of Ser. No. 420,456, filed Sept. 9, 1982, now abandoned.

BACKGROUND OF INVENTION

This invention relates to a powder for plasma spray applications and coating produced by plasma spraying.

SUMMARY OF INVENTION

Silicon nitride is known for its wear resistance and for its lubricity. However, by itself it is not capable of making a good plasma-spray coating. Like many ceramic-type powders, it is difficult to melt in the plasma flame. Thus the resulting coatings are not well melted and poorly adherent to the substrate. In addition, some decomposition of the silicon nitride can occur at the plasma temperature.

In accordance with the present invention, there is provided a plasma spray powder comprising a uniform powder blend of silicon nitride and a plasma meltable metal. A plasma sprayed coating comprises silicon nitride particles in a matrix of the plasma melted metal.

The metal melts during plasma spraying and bonds the particles of silicon nitride to each other and to the substrate. The molten metal fills the interstices between silicon nitride particles to give a dense coating. The coating may be used for piston ring coatings and gas-turbine-component coatings.

DETAILED DESCRIPTION

The plasma meltable metal and silicon nitride are combined to produce a uniform blend. The more intimate the mix, the more likely the silicon nitride will be protected from decomposition during spraying and the less likely the chance for undesirable separation. Preferably the overall blend has an average particle size of less than about 10 microns and comprises from about 20 to about 80 percent by weight silicon nitride. The meltable metal and silicon nitride are preferably utilized in pure form so that the resulting blend consists essentially of silicon nitride particles and meltable metal particles.

The meltable metal preferably melts below the decomposition temperature of silicon nitride. Typical metals comprise nickel, iron, copper or cobalt and alloys thereof. Alloys generally comprise the above metal as a major constituent with minor amounts of secondary metals. Nickel and nickel alloys are preferred. Typical nickel alloys comprise at least 20 percent by weight nickel with the remaining minor constuents being chromium, iron, tungsten, molybdenum, and additives being boron, silicon and carbon. Typical nickel alloys are Ni20Cr or the NiCrBSiC alloys of the AMs 4775 type.

Preferably the uniform powder blend is agglomerated by methods known in the art to produce an agglomerated powder of silicon nitride and meltable metal. Such agglomeration techniques include forming powder compacts and subsequently crushing and screening them. However, agglomeration by spray dyring is in general preferred for its flexibility and economy of operation on a production scale as well as its close control over the size of the agglomerated particles produced.

Conditions under which slurries are formed and spray dried are well known. For example, U.S. Pat. No. 3,617,358, issued Nov. 2, 1971 describes formation of slurries. Other suitable methods for agglomerating are described in U.S. Pat. Nos. 3,881,911; 3,973,948 and 4,025,734, hereinafter discussed.

The agglomerates may be conveniently classified to obtain a desired particle size distribution. It is generally desired to have at least about 50%, more preferably at least about 80% of the particles within a 50 micron average particle size range.

The classified agglomerates are passed through a furnace at low temperatures to decompose the binders used for agglomeration and further treated at high temperatures to strengthen them for subsequent handling.

An alternative method for the incorporation of the meltable powder into the powder is through the binder used for the agglomeration. Conventional binders include such materials as waxes and polyvinyl alcohols. As previously mentioned, these materials decompose during heat treatment, and thus contribute nothing to the constitution of the powder. Alternative binders include soluble salts of the meltabale metal, such as soluble nickel salts. These can be introduced into the slurry for spray drying. Upon drying, these salts serve to bind the fine powders together to form agglomerates. When the agglomerates are passed through a high temperature furnace under a reducing atmosphere the binder decomposes to yield the desired quantity of meltable metal.

The sintered agglomerates can be subsequently screened to yield a particle size distribution suitable for creating thermal sprayed coatings. Typically these distributions having the following preferred ranges of 200 to 325 mesh, and 325 to 15 microns.

The plasma spray powder of the present invention is used to produce a plasma spray coating with a plasma flame reactor. Details of the principles and operation of such plasma flame reactors are well known. The temperature within the plasma flame can be adjusted between 10,000 F. and 30,000 F. The temperature which the particles experience is a function of the rate at which they are fed through the reactor. Commercially available feeding devices allows rates between approximately ½ and 30 pounds per hour, depending on the bulk density of the material being fed. Conditions for plasma spraying are established to melt the meltable metal particles and not decompose, sublime or melt the silicon nitride particles to an appreciable extent. The resulting coating is such that the molten metal fills the interstices between silicon nitride particles to give a dense coating having some of the wear properties of silicon nitride.

EXAMPLE 1

A sintered agglomerated powder is prepared by blending 80/20 nickel-chromium alloy powder, with a particle size less than approximately 50 microns with silicon nitride powder having a particle size less than 10 microns in amounts sufficient to result in a blend comprising 25% of the nickel-chromium alloy and 75% silicon nitride. A slurry is prepared by combining the resulting powder blend with polyvinyl alcohol in the ratio of 98:2 respectively, with enough water to make a 70% solids concentration. Spray drying is carried out by pumping the slurry at low pressure through a two fluid nozzle located at the top of a commercially available spray dryer. The slurry is continually agitated throughout the spray drying run. The atomization air pressure to the nozzle is 40–60 psi. The inlet air temperature is 370 C. to 430 C. with an outlet temperature of 140 to 150 C. The spray dried powder is slowly passed through a hydrogen furnace at 450 C. to remove the organic binder. The resulting particles are screened to yield powders with a −200+325 or a −325+15 μm particle size distribution. These particles can then be used as thermal spray powders.

EXAMPLE 2

The agglomerated spray dried and sintered particles of Example 1 are fed through a commercially available plasma torch into a jacketed water cooled collection tank. A mixture of 126 cubic feet per hour of argon is fed to the plasma torch. The torch power is about 28KVA. Nitrogen gas is fed to a powder feeder at the rate of 7 cubic feet per hour to entrain the powder which is fed through the torch. The torch is held at a distance of about 4 inches from a steel plate and is moved so as to coat the plate with a silicon nitride-nickel alloy coating having a thickness of about 10 mils.

I claim:

1. A plasma spray coating consisting essentially of silicon nitride particles in a matrix of plasma meltable metal.

2. A plasma spray coating according to claim 1 wherein said coating consists essentially of from about 20 to about 80 percent by weight silicon nitride with the remaining portion being meltable metal.

3. A plasma spray coating according to claim 2 wherein said meltable metal consists of nickel or alloy of nickel.

4. A process for producing a coating of silicon nitride particles in a matrix of metal comprising preparing a uniform powder blend consisting essentially of from about 20 to about 80 percent by weight silicon nitride with the remaining portion being a plasma meltable metal, feeding said uniform powder blend through a plasma flame reactor to melt the plasma meltable metal and not appreciably decompose, sublime or melt said silicon nitride and form a dense coating consisting essentially of silicon nitride particles in a matrix of plasma meltable metal.

5. A process for producing a coating of silicon nitride particles in a matrix of metal according to claim 4 wherein after said uniform blend is prepared, said powder blend is agglomerated prior to feeding through a plasma flame reactor.

* * * * *